US006209201B1

(12) United States Patent
Yamada

(10) Patent No.: US 6,209,201 B1
(45) Date of Patent: Apr. 3, 2001

(54) METHOD OF MANUFACTURING A HEAT EXCHANGING FIN

(75) Inventor: Mamoru Yamada, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/346,700

(22) Filed: Jul. 2, 1999

Related U.S. Application Data

(62) Division of application No. 09/156,394, filed on Sep. 18, 1998.

(30) Foreign Application Priority Data

Apr. 8, 1998 (JP) ..... 10-095992

(51) Int. Cl.[7] ..... B23P 15/26
(52) U.S. Cl. ..... 29/890.045; 29/890.043
(58) Field of Search ..... 29/890.043, 890.045, 29/557, 558; 165/182, 181, 151

(56) References Cited

U.S. PATENT DOCUMENTS

| | | | |
|---|---|---|---|
| 2,656,808 | | 10/1953 | Plumeri et al. . |
| 5,150,520 | * | 9/1992 | DeRisi . |
| 5,425,414 | | 6/1995 | Bradley, Jr. et al. . |
| 5,582,246 | | 12/1996 | Dinh . |

FOREIGN PATENT DOCUMENTS

| | | | |
|---|---|---|---|
| 760963 | | 7/1953 | (DE) . |
| 3423746 | | 1/1956 | (DE) . |
| 789553 | | 10/1935 | (FR) . |
| 489099 | | 7/1938 | (GB) . |
| 107897 | | 8/1980 | (JP) . |
| 356001220 | * | 1/1981 | (JP) . |
| 165897 | | 12/1981 | (JP) . |
| 95394 | | 4/1991 | (JP) . |
| 403292107 | * | 12/1991 | (JP) . |

* cited by examiner

*Primary Examiner*—I. Cuda Rosenbaum
(74) *Attorney, Agent, or Firm*—Birch, Stewart, Kolasch & Birch, LLP

(57) ABSTRACT

To provide a heat exchanging fin capable of preventing cracks from forming in the flares of the collared tube holes, even if the metallic plate section is made of thin and tough material. In the heat exchanging fin, a metallic plate section has a plurality of tube holes. A plurality of collars are respectively extended from edges of the tube holes. A plurality of flares are respectively formed at front ends of the collars. Each flare includes a plurality of radially extended sections, which are radially outwardly extended from the front end of each collar. Furthermore, separation between the metallic plate section and each radially extended section is fixed.

10 Claims, 6 Drawing Sheets

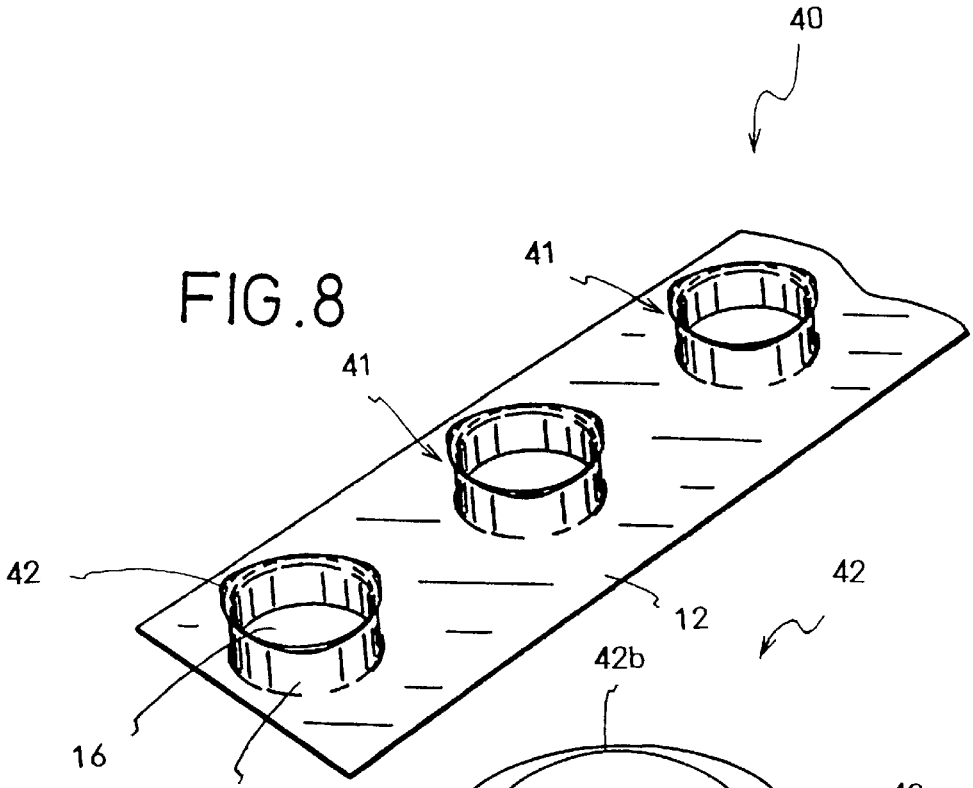
FIG.8
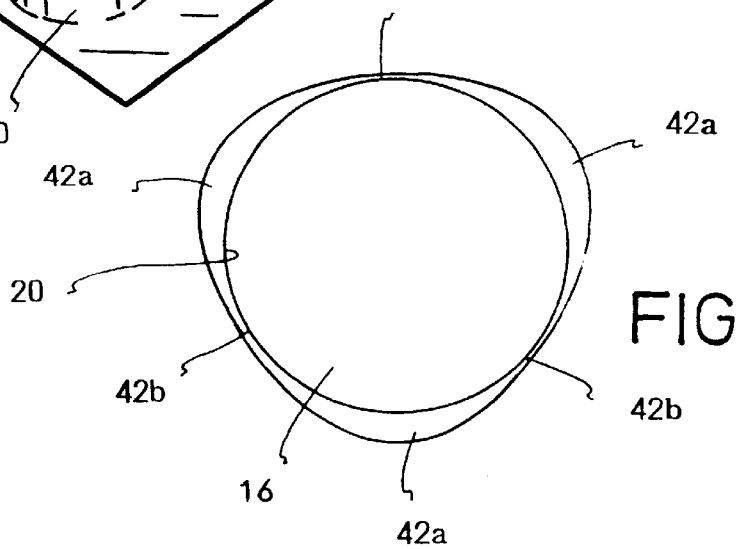
FIG.9
FIG.10A
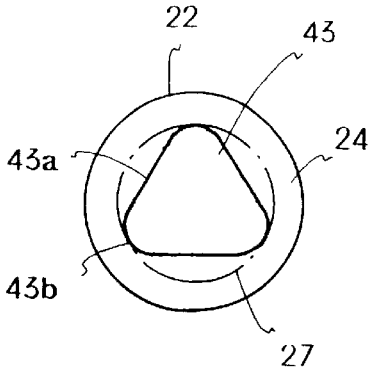
FIG.10B
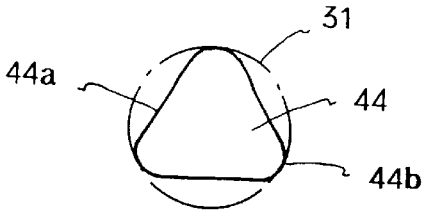

METHOD OF MANUFACTURING A HEAT EXCHANGING FIN

This application is a divisional of co-pending application Ser. No. 09/156,394, filed on Sep. 18, 1998, the entire contents of which are hereby incorporated by reference.

BACKGROUND OF THE INVENTION

1. Field of the Invention

The present invention relates to a heat exchanging fin and a method of manufacturing the heat exchanging fin. More precisely, the present invention relates to a heat exchanging fin and a method of manufacutring the heat exchanging fin, in which collars are formed to respectively enclose tube holes, through which heat exchanging tubes will be inserted. Futhermore the collars respectively have flares at their front ends manufactuing the heat exchanging fin.

2. Description of the Related Art

The heat exchanging fin, which is employed in room air conditioners, car air conditioners, etc., includes: a rectangular metallic plate section, which is made of a metal, e.g., aluminum; and a plurality of collared tube holes provided in the metallic plate section with separations and having a prescribed height.

A heat exchanger is assembled by the steps of: piling the heat exchanging fins, in which the collared tube holes are coaxially arranged; inserting heat exchanging tubes, which are made of a metallic material having high heat conductivity, e.g., copper, through the coaxial tube holes; and expanding the heat exchanging tubes, which have been inserted through the tube holes, so as to integrate the heat exchanging tubes with the heat exchanging fins.

The conventional heat exchanging fin is manufactured by the above-mentioned steps by a drawing manner, which is shown in FIGS. 14A–14F, or a drawless manner, which is shown in FIGS. 15A–15D.

In the drawing manner, shown in FIGS. 14A–14F, a shallow projected section 106, which has a columnar shape or a truncated cone shape, is formed in a thin aluminium plate section 100 (see FIG. 14A). The diameter of the shallow projected section 106 is greater than that of the collared tube holes to be formed. The diameter of the shallow projected section 106 is then reduced and the height thereof is gradually increased by drawing the shallow projected section 106 (see FIGS. 14B–14D).

A top face of the projected section 109, which is formed by drawing the shallow projected section 106 until reaching a prescribed height, is opened and burred to make a cylindrical section 104 (see FIG. 14E). Furthermore, a flare 105 is formed by bending a top end of the cylindrical section 104 (see FIG. 14F).

In the drawless manner, shown in FIGS. 15A–15D, a base hole 101, which is enclosed by a projected part 102, is formed by boring and burring the metallic plate section 100 (see FIG. 15A). The diameter of the base hole 101 is then made greater and the projected part 102 is squeezed until a cylindrical section 104 which has a prescribed height is formed (see FIGS. 15B and 15C).

The flare 105 is formed by bending the top end of the cylindrical section 104 (see FIG. 15D).

The heat exchanging fins having collared tube holes, which include the cylindrical sections 104 and the flares 105, are formed by the manner shown in FIGS. 14A–14F or FIGS. 15A–15D. When the heat exchanging fins are piled, the flares 105 of one heat exchanging fin contact a bottom face of the adjacent heat exchanging fin, so that the separation between the heat exchanging fins can be defined.

In the manner shown in FIGS. 14A–14F or FIGS. 15A–15D, the base hole, which is bored in the top face of the projected section 109 or in the metallic plate section 100, is a circular hole. Furthermore, in the manner shown in FIGS. 14A–14F or FIGS. 15A–15D, the width of the flare 105, which is formed to enclose a circular edge of the top end of the cylindrical section 104, is fixed.

Heat exchanging fins of today must be made light in weight. Therefore, the thickness of the metallic plate section 100 must be made thinner.

On the other hand, tough heat exchanging fins are also required. Namely, heat exchanging fins, which are not only thin but also tough, are required. Therefore the metallic plate section 100 must be made of a thin and tough metallic material.

Extensibility of the thin and tough metallic material is less than that of a thick and soft metallic material. Therefore, it is improper for the thin and tough metallic material to be pressed to form heat exchanging fins. When the flare 105 is formed by bending the top end of the cylindrical section 104, the flare 105 is outwardly pulled. When thin and tough material having a small extensibility is used, a crack 106 may be formed in the flare 105 (see FIG. 16) because the end of the flare 105 is extremely extended.

SUMMARY OF THE INVENTION

An object of the present invention is to provide a heat exchanging fin capable of preventing cracks from forming in the flares of the collared tube holes, even if the metallic plate section is made of the thin and tough material.

Another object of the present invention is to provide a method of manufacturing said heat exchanging fin.

To achieve the objects, the inventor of the present invention has determined that forming cracks in the flares of the collared tube holes can be prevented by forming three radially extended sections as the flare.

The basic structure of the heat exchanging fin of the present invention comprises:

- a metallic plate section having a plurality of tube holes;
- a plurality of collars each of which is extended from an edge of each tube hole; and
- a plurality of flares each of which is formed at a front end of each collar,
- wherein each flare includes a plurality of radially extended sections, which are radially outwardly extended from the front end of each collar, and separation between the metallic plate section and each radially extended section is fixed.

In the heat exchanging fin of the present invention, a shape of an outer edge of each flare may be formed into a polygonal shape. The polygonal shape may be a triangle, a tetragon, etc.

In the heat exchanging fin of the present invention, the radially extended sections of each flare may be provided such that their apexes are located with regular separations in the circumferential direction.

In the heat exchanging fin of the present invention, a shape of an outer edge of each flare may be formed into a regular polygonal shape. The regular polygonal shape may be a regular triangle, a regular tetragon, etc.

In the heat exchanging fin of the present invention, each flare may include a plurality of narrow sections, which are radially outwardly extended from the front end of each collar with a width narrower than that of the radially extended sections.

In the heat exchanging fin of the present invention, the radially extended sections of each flare may be provided with regular separations in the circumferential direction.

The basic structure for performing the method of manufacturing the heat exchanging fin of the present invention includes: a metallic plate section having a plurality of tube holes; a plurality of collars each of which is extended from an edge of each tube hole; a plurality of flares having prescribed height, each flare being formed at a front end of each collar, the method comprising the steps of:

forming a cylindrical section, in which higher sections and lower sections are alternately formed at a front end, along the edge of each tube hole; and forming the flare of each collar by radially outwardly bending the higher sections of the cylindrical section.

In the method of the present invention, the cylindrical section having the higher sections and the lower sections may be formed by the steps of:

forming a projected section, which is formed into a columnar or a truncated cone shape, in the metallic plate section by drawing the metallic plate section;

boring a base hole, which is formed into an elliptic or a polygonal shape, in the projected section; and burring the base hole so as to form the cylindrical section, in which at least two higher sections are formed at the front end, along the edge of the tube hole.

In the method, the base hole may be formed into a triangle or a tetragon.

In the method of the present invention, the higher sections may be provided at the front end of the cylindrical section with regular separations in the circumferential direction.

In the method of the present invention, the base hole is formed into a regular triangle or a regular tetragon.

In the method of the present invention, the cylindrical section having the higher sections and the lower sections may be formed by the steps of:

boring a base hole, which is formed into an elliptic or a polygonal shape, in the metallic plate section;

burring the base hole; and drawing a projected part, which is projected from an edge of the burred base hole, so as to form the cylindrical section, in which at least two higher sections are formed at the front end, along the edge of the tube hole.

In the method of the present invention, the base hole may be formed into a triangle or a tetragon.

In the method of the present invention, the higher sections may be provided at the front end of the cylindrical section with regular separations in the circumferential direction.

In the method of the present invention, the flare may include a plurality of radially extended sections, which are radially outwardly extended from the front end of the collar, and a plurality of narrow sections, which are radially outwardly extended from the front end thereof and whose width is narrower than that of the radially extended sections, wherein the flare is formed by radially outwardly bending the higher sections of the cylindrical section.

As described above, a force pulling an outer edge of the flare is greater than a force pulling an inner edge thereof when the flare, which encloses the top end of the collar with a fixed width, is formed by bending the top end of the cylindrical section.

The top end of the cylindrical section has rough and hard faces, which are formed when the metallic plate section is bored and broken by a die-punch set. Thus, if a greater pulling force, which pulls the outer edge of the flare in the circumferential direction, is applied to the flare, which is formed by bending the top end of the cylindrical section, cracks may be formed in the vicinity of the outer edges of the flares.

On the other hand, in the present invention, the flare of the collar is constituted by a plurality of the radially extended sections, which are arranged at the front end of the collar with separations. With this structure, the pulling force applied to one of the radially extended sections does not influence other radially extended sections. The greater the pulling force capable of pulling the outer edge of the flare can be prevented when the flare is formed at the front end of the cylindrical section by bending, so that forming of cracks in the flare can be prevented.

To manufacture the heat exchanging fins having the collared tube holes, the height of the cylindrical sections must be a prescribed height. Especially, in the conventional heat exchanging fins, the whole edge of the top end of the cylindrical section must have a prescribed height, so the cylindrical section is drawn or squeezed until the whole edge of the top end reaches the prescribed height.

On the other hand, in the present invention, the front end of the cylindrical section is uneven, namely the front end has the higher sections and the lower sections. Futhermore, the top ends of the higher sections must have a prescribed height. The whole edge of the front end of the cylindrical section need not have the prescribed height, so the heat exchanging fins can be easily manufactured. Futher scope of applicability of the present invention will become apparent from the detailed description given hereinafter. However, it should be understood that the detailed description and specific examples, while indicating preferred embodiments of the invention, are given by the way of illustrations only, since various changes and modifications within the spirit and scope of the invention will become apparent to those skilled in the art from this detailed description.

BRIEF DESCRIPTION OF THE DRAWINGS

Embodiments of the present invention will now be described by way of examples and with reference to the accompanying drawings, in which:

FIG. 8 is a perspective view of the heat exchanging fin of another embodiment;

FIG. 9 is a plan view of a collared tube hole 41 of the heat exchanging fin shown in FIG. 8;

FIG. 10A is a plan view of the base hole 26 bored in the step shown in FIG. 4B;

FIG. 10B is a plan view of the base hole 30 bored in the step shown in FIG. 6A;

DETAILED DESCRIPTION OF THE PREFERRED EMBODIMENTS

Preferred embodiments of the present invention will now be described in detail with reference to the accompanying drawings.

Figure 1:
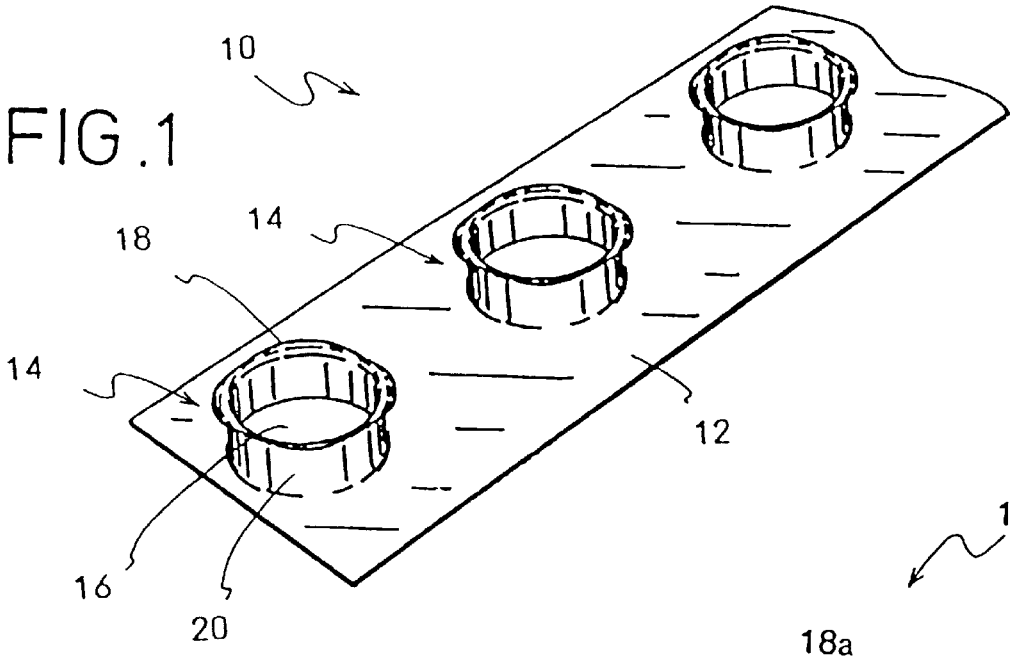
FIG. 1 is a perspective view of the heat exchanging fin of an embodiment of the present invention.

FIG. 1 is a perspective view of the heat exchanging fin of the embodiment. The heat exchanging fin 10 shown in FIG. 1 includes: a rectangular metallic plate section 12, which is made of aluminum; and a plurality of collared tube holes 14, which are linearly arranged in the longitudinal direction of the plate section 12. Each collared tube hole 14 has a collar 20, in which an edge of a tube hole 16 is enclosed by a flare 18.

Figure 2:
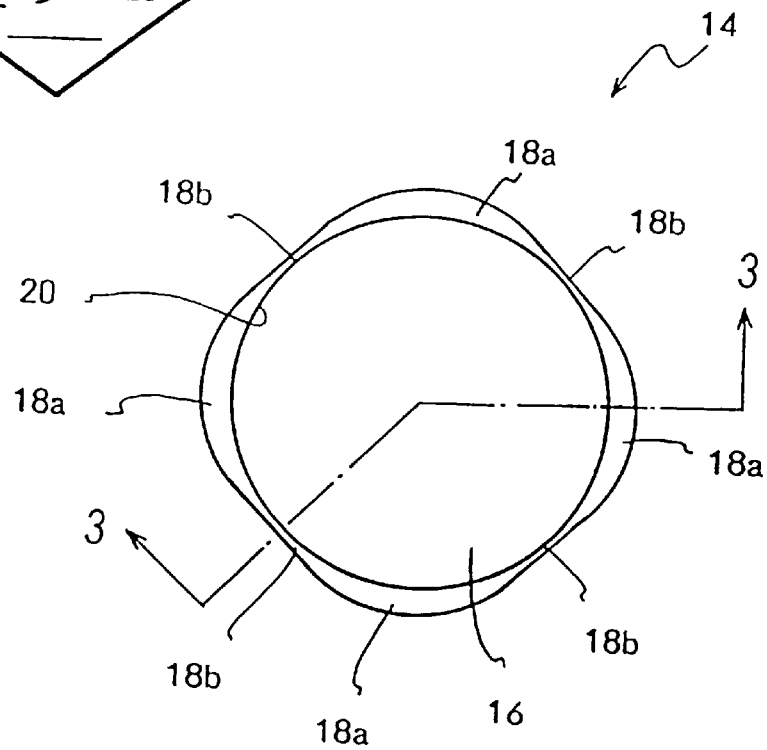
FIG. 2 is a plan view of a collared tube hole 14 of the heat exchanging fin shown in FIG. 1.

As shown in FIG. 2, the flare 18 includes: radially extended sections 18*a,* which are outwardly extended from a front (upper) end of the collar 20; and narrow sections 18*b,* having a width narrower than that of the radially extended sections 18*a*. The radially extended sections 18*a* are provided along an outer circumferential face of the collar 20 with regular separations.

As shown in FIG. 1, the flare 18 is formed into a regular tetragon having rounded corners.

It should be noted that the shape of the flare 18 is not limited to a regular tetragon, but may be a rectangle having angular corners, etc.

Figure 3:
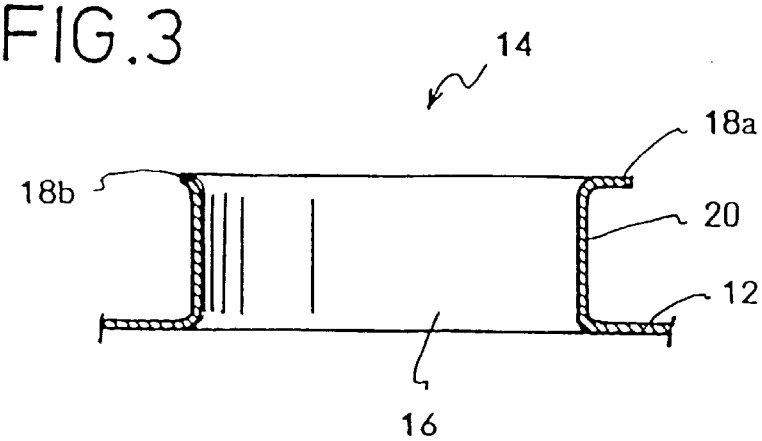
FIG. 3 is a sectional view of the collared tube hole 14 taken along a line 3—3 shown in FIG. 2.

A sectional view of the collared tube hole 14 taken along a line 3—3 of FIG. 2 is shown in FIG. 3. As shown in FIG. 3, the radially extended sections 18*a* include flat sections (upper faces of the radially extended sections 18*a*). When the heat exchanging fins 10 are vertically piled, the flat sections of the radially extended sections 18*a* contact a bottom face of another heat exchanging fin 10, which is located on the upper side so as to support said heat exchanging fin. The separation between the metallic plate section 12 and each flat section of the radially extended section 18*a* is fixed. Therefore the radially extended section 18*a* can stably support the upper heat exchanging fin 10, and the adjacent heat exchanging fins 10 can be separated with fixed separations.

The narrow sections 18*b* have no flat sections, so they do not support another heat exchanging fin 10. Preferably, the height of the highest points of the narrow sections 18*b* is equal to that of the flat sections of the radially extended sections 18*a*. If the height of the narrow sections 18*b* is lower than that of the radially extended sections 18*a,* an outer circumferential face of the heat exchanging tubes, which are pierced through the tube holes 16 of the piled heat exchanging fins 10, are exposed. If the tubes are visible between the heat exchanging fins 10, the external appearance and heat exchangiblity are bad.

As shown in FIG. 3, the narrow sections 18*b* are outwardly bent with respect to an inner circumferential face of the tube hole 16, so that the heat exchanging tube can be smoothly inserted in the tube hole 16.

A method of manufacturing the heat exchanging fin 10, which includes the collared tube holes 14 formed by the drawing manner shown in FIGS. 14A–14F, shown in FIGS. 1–3 will be explained with reference to FIGS. 4A–4D.

Figure 4A:
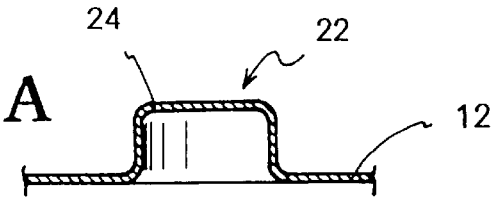
FIGS. 4A–4D are sectional views showing the steps of manufacturing the heat exchanging fin shown in FIG. 1.

In FIGS. 4A–4D, a projected section 22 shown in FIG. 4A can be formed by the steps of FIGS. 14A–14D, which have been explained in the drawing manner shown in FIGS. 14A–14F.

Figure 4B:
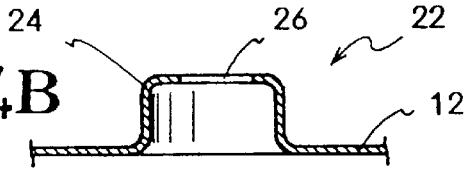
Figure 5:
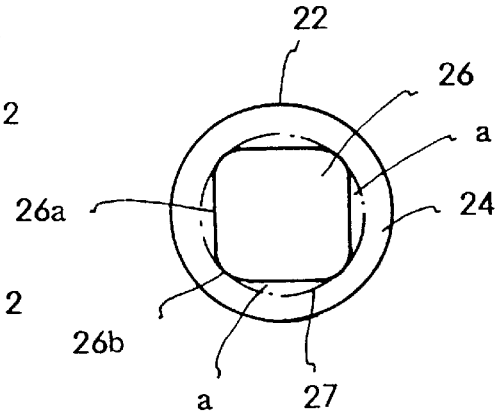
FIG. 5 is a plan view of a base hole 26 bored in the step shown in FIG. 4B.

A base hole 26 is bored in a flat face 24 of the projected section 22, which has been formed in the step of FIG. 4A (see FIG. 4B). As shown in FIG. 5, the area of the base hole 26 is smaller than that of the flat face 24 of the projected section 22, and the base hole 26 is formed into a regular tetragon having rounded corners.

Figure 4C:
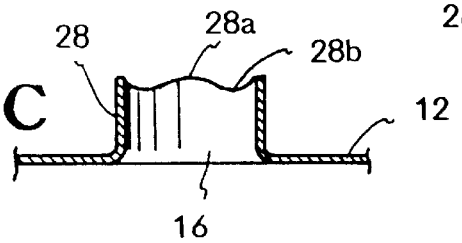
Figure 4D:
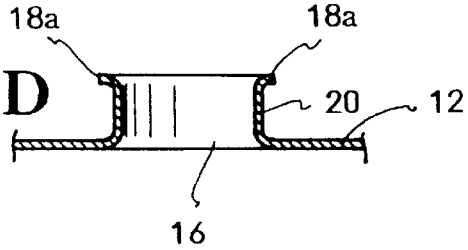

The base hole 26, which has been bored in the flat face 24 of the projected section 22, is then burred so as to form a cylindrical section 28 having a front (upper) end formed in a zigzag (see FIG. 4C). In the zigzag front end of the cylindrical section 28, higher sections 28*a* and lower sections 28*b* are alternately formed, namely four higher sections 28*a* (or four lower sections 28*b*) are arranged in the circumferential direction with regular separations.

The higher sections 28*a* correspond to middle parts of linear edges 26*a* of the base hole 26 shown in FIG. 5, which has been bored in the flat face of the projected section 22; the lower sections 28*b* correspond to corners 26*b* of the base hole 26 shown in FIG. 5.

The zigzag front end of the cylindrical section 28 is then pressed. Four higher sections 28*a* are simultaneously pressed to bend outwardly, so that four radially extended sections 18*a,* which are radially outwardly extended from the front end of the collar 20, are formed (see FIG. 4D). The higher sections 28*a* are pressed until the flat sections are formed. Furthermore, parts of the lower sections 28*b* are pressed to form the narrow sections 18*b,* having a width narrower than that of the radially extended sections 18*a* as shown in FIGS. 2 and 3. Preferably, the separation between the plate section 12 and each of the narrow sections 18*b* is equal to that between the plate section 12 and each of the radially extended sections 18*a*.

In the method shown in FIGS. 4A–4D, the step of boring the base hole 26, which is formed into the regular tetragon, in the flat face 24 of the projected section 22 (see FIG. 4B) and the step of burring the base hole 26 (see FIG. 4C) may be executed separately. The boring step and the burring step may be executed simultaneously. In this case, the steps may be executed in a press machine, in which the steps are executed in a stroke of a movable die.

In the boring step in which the base hole is bored in the flat face 24 of the projected section 22 (see FIG. 4B), the corners of the tetragonal base hole 26 may be angular, and the base hole 26 may be formed into a rectangular shape.

A method of manufacturing the heat exchanging fin 10, which includes the collared tube holes 14 formed by the drawless manner shown in FIGS. 15A–15D, shown in FIGS. 1–3 will be explained with reference to FIGS. 6A–6D.

Figure 6A:
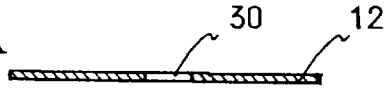
FIG. 6A–6D are sectional views showing the steps of manufacturing the heat exchanging fin shown in FIG. 1.
Figure 7:
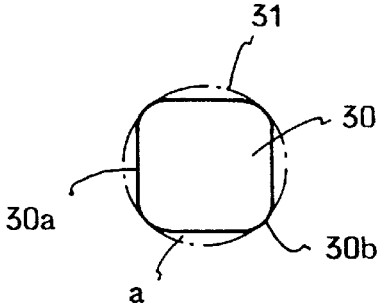
FIG. 7 is a plan view of a base hole 30 bored in the step shown in FIG. 6A.
Figure 16:
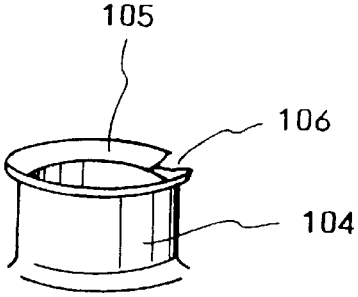
FIG. 16 is a perspective view of the collared tube hole, in which a crack is formed in the flare.

In the drawless manner, a base hole 30 is bored in the metallic plate section 12 (see FIG. 6A). As shown in FIG. 7, the base hole 30 is formed into a regular tetragon having rounded corners.

Figure 6B:
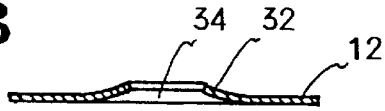

The base hole 30 is then burred to form a burred hole 34 having an edge enclosed by a projected part 32 (see FIG. 6B). The diameter of the burred hole 34 is then increased, and the projected part 32 is squeezed until an upper zigzag end of a cylindrical section 36 reaches a prescribed height (see FIG. 6C). In the upper zigzag end of the cylindrical section 36, higher sections 36*a* and lower sections 36*b* are alternately formed. Four higher sections 36*a* (or four lower sections 36*b*) are arranged in the circumferential direction of the cylindrical section 36 with regular separations.

The higher sections 36*a* correspond to middle parts of linear edges 30*a* of the base hole 30 shown in FIG. 7, which has been bored in the metallic plate section 12. The lower sections 36*b* correspond to corners 30*b* of the base hole 30 shown in FIG. 7.

The zigzag front end of the cylindrical section 36 is then pressed. Four higher sections 36*a* are simultaneously pressed to bend outwardly, so that four radially extended sections 18*a,* which are radially outwardly extended from the front end of the collar 20, are formed (see FIG. 6D). The higher sections 36*a* are pressed until the flat sections are formed. Furthermore, parts of the lower sections 36*b* are pressed to form the narrow sections 18*b* having a width narrower than that of the radially extended sections 18*a* as shown in FIGS. 2 and 3. Preferably, the separation between the plate section 12 and each narrow sections 18*b* is equal to that between the plate section 12 and each radially extended section 18*a*.

In the step of boring the base hole 30 in the plate section 12 (see FIG. 6A), the tetragonal base hole 30 may have angular corners, and the base hole 30 may be formed into a rectangle.

In the method shown in FIGS. 6A–6D, the step of boring the base hole 30, which is formed into the regular tetragon, in the plate section 12 (see FIG. 6A) and the step of burring the base hole 30 (see FIG. 6B) may be executed separately. The boring step and the burring step may be executed simultaneously. In this case, the steps may be executed in a press machine, in which the steps are executed in a stroke of a movable die.

In the drawing manner shown in FIG. 4A–4D, the base hole 26, which is formed into the regular tetragon, is bored in the flat face 24 of the projected section 22 (see FIGS. 6A–6D). The height of the collared tube hole 14 is higher than that of a collared tube hole based on a circular base hole 27, which is indicated by a one-dot chain line shown in FIG. 5. In FIG. 5, parts "a", which are located between the tetragonal base hole 26 and the circular base hole 27 enclosing the base hole 26, will constitute the higher sections 28*a* of the cylindrical section 28 shown in FIG. 4C, which is formed by burring the base hole 26, so that the height of the collared tube hole 14 can be higher.

To make the flare 18, the higher sections 28*a* of the cylindrical section 28 are pressed and bent to form the radially extended sections 18*a*. Therefore, the height of the top ends of the higher sections 28*a* of the cylindrical section 28, from the metallic plate section 12, must be a prescribed height. The entire edge of the top end of the cylindrical section 28 need not be of the prescribed height.

When four radially extended sections 18*a* are formed by simultaneously bending four higher sections 28*a,* the radially extended sections 28*a* are arranged along the edge of the collar 20 with separations. Therefore, the pulling force applied to one of the radially extended sections 18*a* does not influence other radially extended sections 18*a*.

By boring the regular tetragonal base hole 26 in the flat face 24 of the projected section 22, the height of the collared tube hole 14 can be higher than that of the collared tube hole based on the circular base hole 27. If the height of the collared tube hole 14 is equal to that of the collared tube hole based on the circular base hole 27, the height of the projected section 22 can be lower. Thus, the thickness of the metallic plate section 12 may be thinner and harder than that of a metallic plate section in which the circular base holes 27 will be bored.

In the case of the collared tube hole, which is manufactured by the drawing manner shown in FIGS. 14A–14F, if the thickness of the aluminum plate section 12 is 0.1 mm and the diameter of the tube hole 16 is 10 mm, the height of the collar can be 2 mm or less. On the other hand, in the case of the drawing manner shown in FIGS. 4A–4D, the height of the collar 20, which has the flare 18, can be 2.3 mm.

Figure 6C:
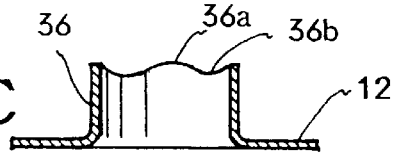
Figure 6D:
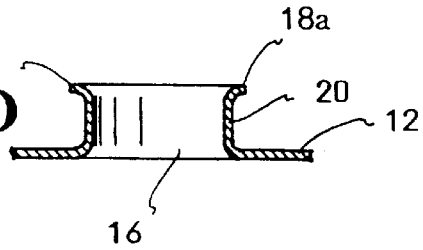

In the drawless manner shown in FIGS. 6A–6D, the parts "a", which are located between the regular tetragonal base hole 30 and a circular base hole 31 (indicated by a one-dot chain line) enclosing the base hole 30, are formed in the plate section 12, so that the parts "a" form the cylindrical section 36 shown in FIG. 6C. The cyindrical section 36 is formed by burring the base hole 30, increasing the diameter of the burred base hole 34 and squeezing the projected part 32 higher.

To make the flare 18, the higher sections 36*a* of the cylindrical section 36 are pressed and bent to form the radially extended sections 18*a*. Therefore, the height of the top ends of the higher sections 36*a* of the cylindrical section 36 must be a prescribed height. The entire edge of the top end of the cylindrical section 36 need not be of the prescribed height. When four radially extended sections 18*a* are formed by simultaneously bending four higher sections 36*a,* the pulling force applied to one of the radially extended sections 18*a*. does not influence other radially extended sections 18*a* in the same way as in the drawing manner.

If the height of the collared tube hole 14 is equal to that of the collared tube hole based on the circular base hole 31, the height of the cylindrical section 36 can be lower. Thus, the degree of increase in diameter of the burred base hole 34 and squeezing the projected part 32 can be lower. Therefore, the collared tube hole 14 having the prescribed height can be formed even if the plate section 12 is made of a thin and hard material having lower extensibility.

In the above described embodiments, the external shape of the flare 18 of the collared tube hole 14 is a regular tetragonal shape. The external shape of the flare 18 is not limited. Therefore, the external shape of the flare 18 of the collared tube hole 14 may be a regular triangle as shown in FIG. 8.

The heat exchanging fin shown in FIG. 8 includes the rectangular metallic plate section 12, which is made of aluminum and a plurality of the collared tube holes 41, which are linearly arranged in the longitudinal direction of the plate section 12. Each collared tube hole 41 has the collar 20, in which an edge of the tube hole 16 is enclosed by a flare 42.

As shown in FIG. 9, the flare 42 includes: radially extended sections 42*a,* which are outwardly extended from the front (upper) end of the collar 20 and narrow sections 42*b* having a width narrower than that of the radially extended sections 42*a*. The radially extended sections 42*a* are provided along the outer circumferential face of the collar 20 with regular separations.

As shown in FIG. 8, the flare 42 is formed into a regular triangle having rounded corners.

It should be noted that the shape of the flare 42 is not limited to a regular triangle having rounded corners, but may have angular corners and it may be an equilateral triangle, etc.

The heat exchanging fins shown in FIGS. 8 and 9, which have the collared tube holes 41, can be manufactured by the method shown in FIGS. 4A–4D or FIGS. 6A–6D. The methods shown in FIGS. 4A–4D and FIGS. 6A–6D have been described. Therefore, a detailed explanation will be omitted.

In the boring step (see FIG. 4B or 6A), the shape of the base hole 26 or 30 is formed into a regular triangle 43 or 44, which has rounded corners, as shown in FIG. 10A or 10B. Therefore, the heat exchanging fins having the collared tube holes 41 with a shape as shown in FIG. 8 or 9, can be manufactured.

The step shown in FIG. 10A corresponds to the step shown in FIG. 4B and the step shown in FIG. 10B corresponds to the step shown in FIG. 6A.

The higher sections 28*a* or 36*a,* which are shown in FIG. 4C or 6C, correspond to middle parts of linear edges 43*a* or 44*a* of the triangular base hole 43 or 44 shown in FIG. 10A or 10B.

Corners 43*b* or 44*b* of the triangular base hole 43 or 44, which is included in the circular base hole 27 or 31, will constitute the lower sections 28*b* or 36*b* of the cylindrical section 28 or 36 shown in FIG. 4C or 6C.

Figure 11:
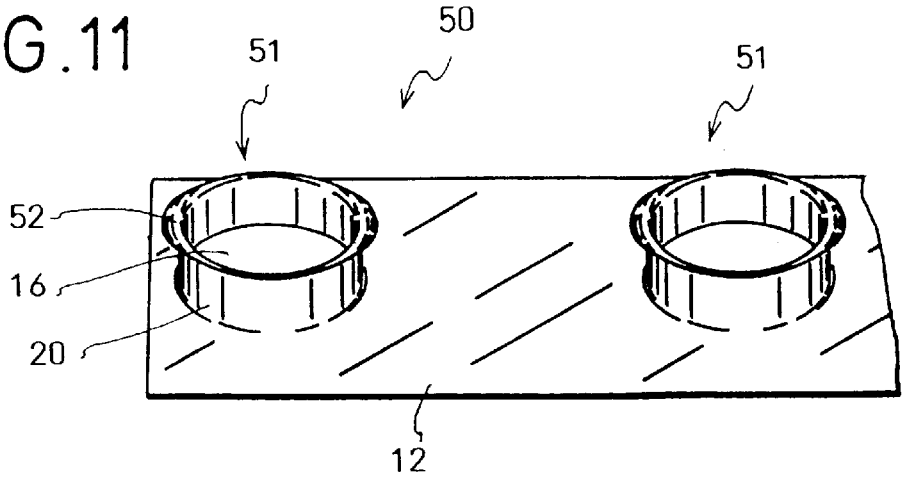
FIG. 11 is a perspective view of the heat exchanging fin of another embodiment.

In FIGS. 1–10B, the flares of the collared tube holes are formed into polygons, but the external shape of the flares may be an ellipse as shown in FIG. 11.

The heat exchanging fin shown in FIG. 11 includes the rectangular metallic plate section 12, which is made of aluminum and a plurality of the collared tube holes 51, which are linearly arranged in the longitudinal direction of the plate section 12. Each collared tube hole 51 has the collar 20, in which an edge of the tube hole 16 is enclosed by a flare 52.

Figure 12:
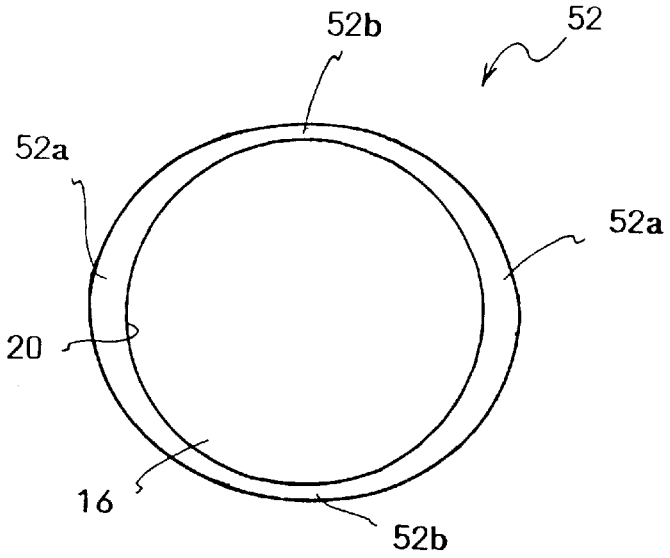
FIG. 12 is a plan view of a collared tube hole 52 of the heat exchanging fin shown in FIG. 11.

As shown in FIG. 12, the flare 52 includes radially extended sections 52*a,* which are outwardly extended the front end of the collar 20 and narrow sections 52*b* having a width narrower than that of the radially extended sections 52*a.* The radially extended sections 52*a* are symmetrically provided with respect to the tube hole 16.

As shown in FIG. 12, the flare 52 shown in FIG. 11 is formed into an ellipse, and the radially extended sections 52*a* are expanded in the longitudinal direction of the plate section 12.

The heat exchanging fins shown in FIGS. 11 and 12, which have the collared tube holes 51, can be manufactured by the method shown in FIGS. 4A–4D or FIGS. 6A–6D. The methods shown in FIGS. 4A–4D and FIGS. 6A–6D have been described. Therefore, a detailed explanation will be omitted.

Figure 13A:
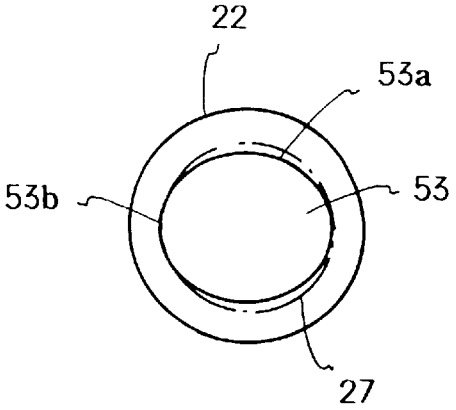
FIG. 13A is a plan view of the base hole 26 bored in the step shown in FIG. 4B.
Figure 13B:
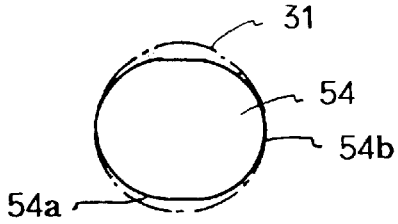
FIG. 13B is a plan view of the base hole 30 bored in the step shown in FIG. 6A.
Figure 14A:
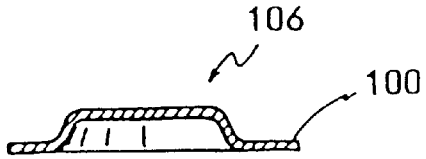
FIG. 14 A PRIOR ART
FIGS. 14A–14F are sectional views showing the steps of manufacturing the conventional heat exchanging fin.
Figure 14B:
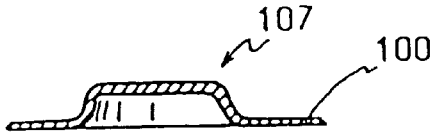
FIG. 14 B PRIOR ART
Figure 14C:
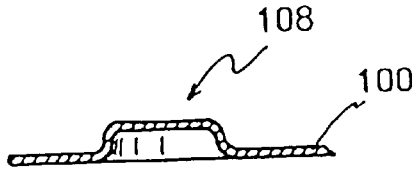
FIG. 14 C PRIOR ART
Figure 14D:
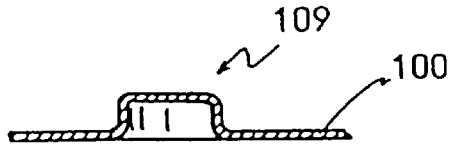
FIG. 14 D PRIOR ART
Figure 14E:
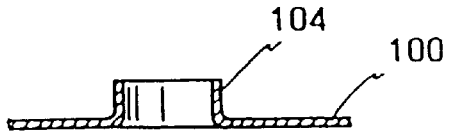
FIG. 14 E PRIOR ART
Figure 14F:
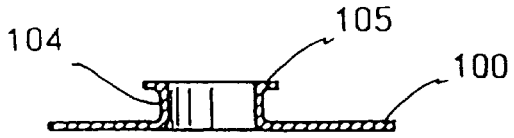
FIG. 14 F PRIOR ART
Figure 15A:
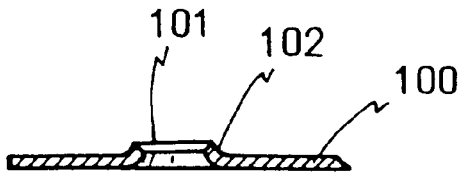
FIG. 15A PRIOR ART
FIGS. 15A–15D are sectional views showing the steps of manufacturing the conventional heat exchanging fin.
Figure 15B:
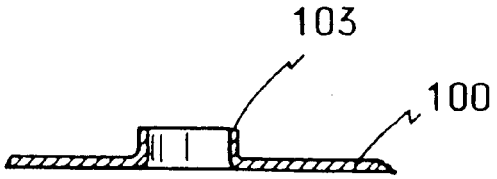
FIG. 15B PRIOR ART
Figure 15C:
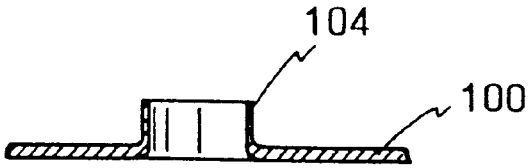
FIG. 15C PRIOR ART
Figure 15D:
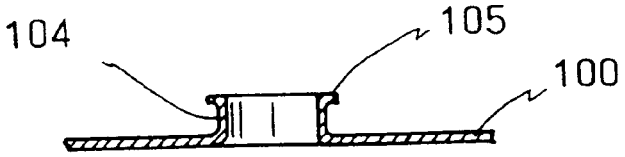
FIG. 15D PRIOR ART

It should be noted that in the boring step (see FIG. 4B or 6A), the shape of the base hole 26 or 30 is formed into the ellipse 53 or 54 as shown in FIG. 13A or 13B, so that the heat exchanging fins having the collared tube holes 51, with a shape as shown in FIG. 11 or 12, can be manufactured.

The step shown in FIG. 13A corresponds to the step shown in FIG. 4B and the step shown in FIG. 13B corresponds to the step shown in FIG. 6A.

The higher sections 28*a* or 36*a,* which are shown in FIG. 4C or 6C, correspond to middle parts of edges 53*a* or 54*a,* which are arranged in the direction of the line of upside, of the elliptical base hole 53 or 54 shown in FIG. 13A or 13B.

The edges 53*a* shown in FIG. 13A are curved edges, and the edges 54*a* shown in FIG. 13B are linear edges, but both edges 53*a* and 54*a* can be formed into the flares 52.

The edges 53*b* or 54*b* of the elliptical base hole 53 or 54, which is included in the circular base hole 27 or 31, will constitute the lower sections 28*b* or 36*b* of the cylindrical section 28 or 36 shown in FIG. 4C or 6C.

In the above described embodiments shown in FIGS. 1, 8 and 11, the collared tube holes 14, 41 and 51 are linearly arranged in the longitudinal direction of the plate section 12, but the collared tube holes 14, 41 and 51 may be arranged in two lines or in a zigzag form.

Edges of the radially extended sections 18*a,* 42*a* and 52*a,* which are radially outwardly extended from the upper ends of the collars 20, may be curled toward the metallic plate sections 12. In this case, the curled parts are formed in the radially extended sections 18*a,* 42*a* and 52*a* and no curled parts are formed in the narrow sections 18*b,* 42*b* and 52*b.* With this structure, machining oil, which invades in the curled parts while press machining, can be easily removed.

As described above, in the present invention, the collared tube holes having the prescribed height can be formed in the thin and hard plate section, so that the heat exchanging fins can be lighter.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A method of manufacturing a heat exchanging fin including: a metallic plate section having a plurality of tube holes; a plurality of collars each of which is extended from an edge of each tube hole; a plurality of flares having a prescribed height, each flare being formed at a front end of each collar, said method comprising the steps of:

forming a cylindrical section, in which higher sections and lower sections are alternately formed at a front end, along the edge of each tube hole, said cylindrical section having the higher sections and the lower sections being formed by the steps of:

forming a projected section, which is formed into a columnar or a truncated cone shape, in said metallic plate section by drawing said metallic plate section;

boring a base hole, which is formed into an elliptic or a polygonal shape, in said projected section; and burring said base hole so as to form said cylindrical section, in which at least two higher sections are formed at the front end, along the edge of the tube hole; and forming the flare of each collar by radially outwardly bending the higher sections of said cylindrical section.

2. The method of manufacturing a heat exchanging fin according to claim 1, wherein said step of boring further comprises the step of forming the base hole into a triangle or a tetragon.

3. The method of manufacturing a heat exchanging fin according to claim 1, wherein said step of forming a cylindrical section further comprises the step of forming the higher sections at the front end of said cylindrical section with regular separations in the circumferential direction.

4. The method of manufacturing a heat exchanging fin according to claim 1, wherein said step of boring further comprises the step of forming the base hole into a regular triangle or a regular tetragon.

5. The method of manufacturing a heat exchanging fin according to claim 1, wherein said flare includes a plurality of radially extended sections, which are radially outwardly extended from the front end of said collar, and a plurality of narrow sections, which are radially outwardly extended from the front end thereof and whose width is narrower than that of said radially extended sections, and wherein said flare is formed by radially outwardly bending the higher sections of said cylindrical section.

6. A method of manufacturing a heat exchanging fin including:

a metallic plate section having a plurality of tube holes; a plurality of collars each of which is extended from an edge of each tube hole; a plurality of flares each of which is formed at a front end of each collar, said method comprising the steps of:

forming a cylindrical section, in which higher sections and lower sections are alternately formed at a front end, along the edge of each tube hole, said cylindrical section having the higher sections and the lower sections being formed by the steps of:

forming a projected section, which is formed into a columnar or a truncated cone shape, in said metallic plate section by drawing said metallic plate section;

boring a base hole, which is formed into an elliptic or a polygonal shape, in said projected section; and burring said base hole so as to form said cylindrical section, in which at least two higher sections are formed at the front end, along the edge of the tube hole; and forming the flare of each collar by radially outwardly bending the higher sections of said cylindrical section.

7. The method of manufacturing a heat exchanging fin according to claim 6, wherein said step of boring further comprises the step of forming the base hole into a triangle or a tetragon.

8. The method of manufacturing a heat exchanging fin according to claim 6, wherein said step of forming a cylindrical section further comprises the step of forming the higher sections at the front end of said cylindrical section with regular separations in the circumferential direction.

9. The method of manufacturing a heat exchanging fin according to claim 6, wherein said step of boring further comprises the step of forming the base hole into a regular triangle or a regular tetragon.

10. The method of manufacturing a heat exchanging fin according to claim 6, wherein said flare includes a plurality of radially extended sections, which are radially outwardly extended from the front end of said collar, and a plurality of narrow sections, which are radially outwardly extended from the front end thereof and whose width is narrower than that of said radially extended sections, and wherein said flare is formed by radially outwardly bending the higher sections of said cylindrical section.

* * * * *